US007660392B2

(12) United States Patent
DeSalvo et al.

(10) Patent No.: US 7,660,392 B2
(45) Date of Patent: Feb. 9, 2010

(54) PIXEL ARRAY ARRANGEMENT FOR A SOFT X-RAY SOURCE

(75) Inventors: John Richard DeSalvo, Satellite Beach, FL (US); Carol Ann Gamlen, Melbourne, FL (US); Charles M. Newton, Palm Beach, FL (US); William T. Silfvast, Saint Helen, CA (US); Gregory M. Shimkaveg, Oviedo, FL (US)

(73) Assignee: Harris Corporation, Melbourne, FL (US)

( * ) Notice: Subject to any disclaimer, the term of this patent is extended or adjusted under 35 U.S.C. 154(b) by 23 days.

(21) Appl. No.: 11/986,703

(22) Filed: Nov. 26, 2007

(65) Prior Publication Data

US 2009/0136001 A1 May 28, 2009

(51) Int. Cl.
*H01J 35/08* (2006.01)

(52) U.S. Cl. ..... 378/124; 378/141

(58) Field of Classification Search ..... 378/119, 378/124, 134, 136, 141, 143
See application file for complete search history.

(56) References Cited

U.S. PATENT DOCUMENTS

| | | | | | |
|---|---|---|---|---|---|
| 3,993,971 | A * | 11/1976 | Ono et al. | ..... | 335/202 |
| 5,176,771 | A * | 1/1993 | Bravo et al. | ..... | 156/85 |
| 6,081,423 | A * | 6/2000 | Griffin | ..... | 361/688 |
| 6,259,765 | B1 * | 7/2001 | Baptist | ..... | 378/136 |
| 6,553,096 | B1 * | 4/2003 | Zhou et al. | ..... | 378/122 |
| 2003/0063707 | A1 * | 4/2003 | Mulhollan | ..... | 378/134 |
| 2005/0117705 | A1 * | 6/2005 | Morrison et al. | ..... | 378/136 |
| 2006/0056595 | A1 * | 3/2006 | Sampayon | ..... | 378/119 |

* cited by examiner

*Primary Examiner*—Edward J Glick
*Assistant Examiner*—Mona M Sanei
(74) *Attorney, Agent, or Firm*—Harness, Dickey & Pierce PLC

(57) ABSTRACT

A pixel array arrangement is provided for a soft x-ray source. The arrangement includes: a window-frame structure having a plurality of channels passing therethrough, where each channel forms a pixel for the x-ray source; a cathode disposed on one side of each channel in the window-frame structure and operable to emit electrons into the channel; and an anode disposed in each cavity on an opposing side of the channel from the cathode and operable to emit x-ray radiation when electrons from the cathode impinge thereon, where the anode is configured to emit x-ray radiation at a diffused angle such that the x-ray radiation from a given pixel overlaps with x-ray radiation from adjacent pixels.

7 Claims, 7 Drawing Sheets

PIXEL ARRAY ARRANGEMENT FOR A SOFT X-RAY SOURCE

FIELD

The present disclosure relates to x-ray radiation and, more particularly, to a pixel arrangement for a soft x-ray radiation source.

BACKGROUND

Electromagnetic radiation offers many advantages over chemicals or heat as a decontaminant. Radiation is generally much less disturbing to the object being sterilized than either reactive oxidizers like chlorine or high temperatures. In addition, radiation can be applied with less labor and hence involve less risk. Unfortunately, germicidal ultraviolet radiation will not penetrate many common materials such as paper, plastics, fibers or metals. In contrast, high energy gamma rays will penetrate many objects, but require very large doses due to the small probability of interaction with the biological pathogens of interest, thereby further requiring massive shielding for safe use. X-ray radiation has been found to be a suitable decontaminant, is penetrating, and can be controlled simply and safely.

Design of the x-ray source for decontamination applications is qualitatively different than for conventional x-ray tubes used for imaging. Importantly, the x-ray emitting area needs to be large so that sharp shadows in the illuminated volume are avoided. If sharp, high contrast shadows occur, microscopic pathogens could escape from the irradiation and circumvent the desired sterilization. During operation, the x-rays are emitted from the outermost few microns of anode material which receives electron bombardment, so the electron beam must be tailored to impinge over the full surface of the anode to achieve the largest effective source size. To this end, the electric field guiding the electrons must be crafted to diverge from the cathode and intersect the anode uniformly, to the greatest extent possible. This technique of tailoring the electric field distribution in the x-ray source is further described in U.S. Patent Application Publication No. 2008/0056448 which is incorporated herein by reference. However, it remains desirable to develop an integrated device for delivery of soft x-ray radiation in such decontamination applications.

The statements in this section merely provide background information related to the present disclosure and may not constitute prior art.

SUMMARY

A pixel array arrangement is provided for a soft x-ray source. The arrangement includes: a window-frame structure having a plurality of channels passing therethrough, where each channel forms a pixel for the x-ray source; a cathode disposed on one side of each channel in the window-frame structure and operable to emit electrons into the channel; and an anode disposed in each cavity on an opposing side of the channel from the cathode and operable to emit x-ray radiation when electrons from the cathode impinge thereon, where the anode is configured to emit x-ray radiation at a diffused angle such that the x-ray radiation from a given pixel overlaps with x-ray radiation from adjacent pixels.

An integrated x-ray radiation device is provided in another aspect of this disclosure. The integrated radiation device includes a window-frame structure having a plurality of channels passing between opposing surfaces of the window-frame structure; an cathode plate disposed adjacent to one of the surfaces of the window-frame structure having the plurality of channels formed therein; an anode plate disposed adjacent to a surface of the window-frame structure opposite from the cathode plate; an insulating member having a top surface adjacent to the anode plate and a bottom surface for mounting electronic components thereto; and a housing that cooperatively functions with the anode plate to form an enclosure for the other components of the x-ray radiation device.

The device as described below is modular. Arrays of these devices can be arranged in two-dimensional and three-dimensional geometries to constitute irradiation systems of wide versatility.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
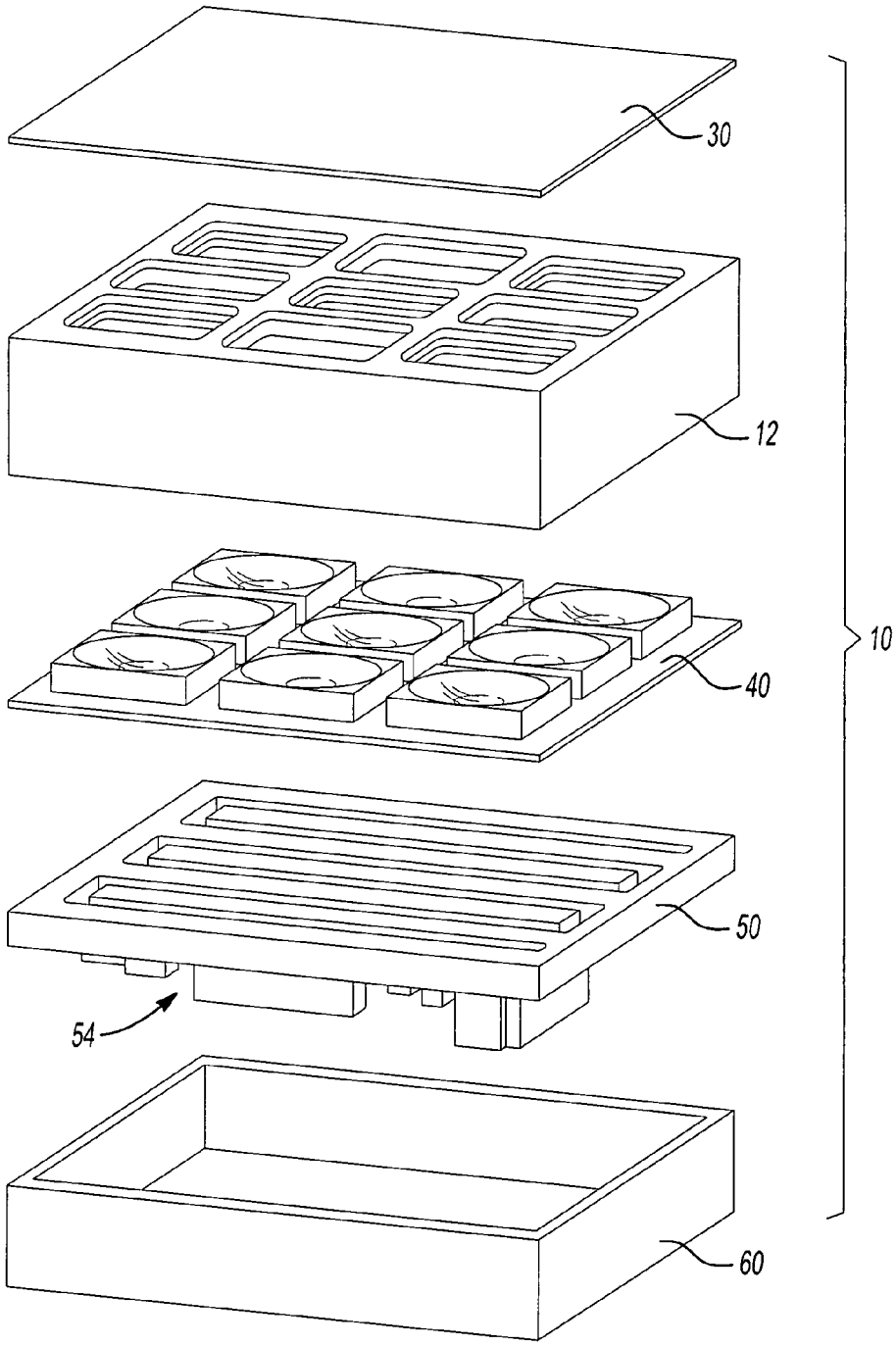
FIG. 1 is an exploded view of an integrated soft x-ray radiation device.
Figure 2:
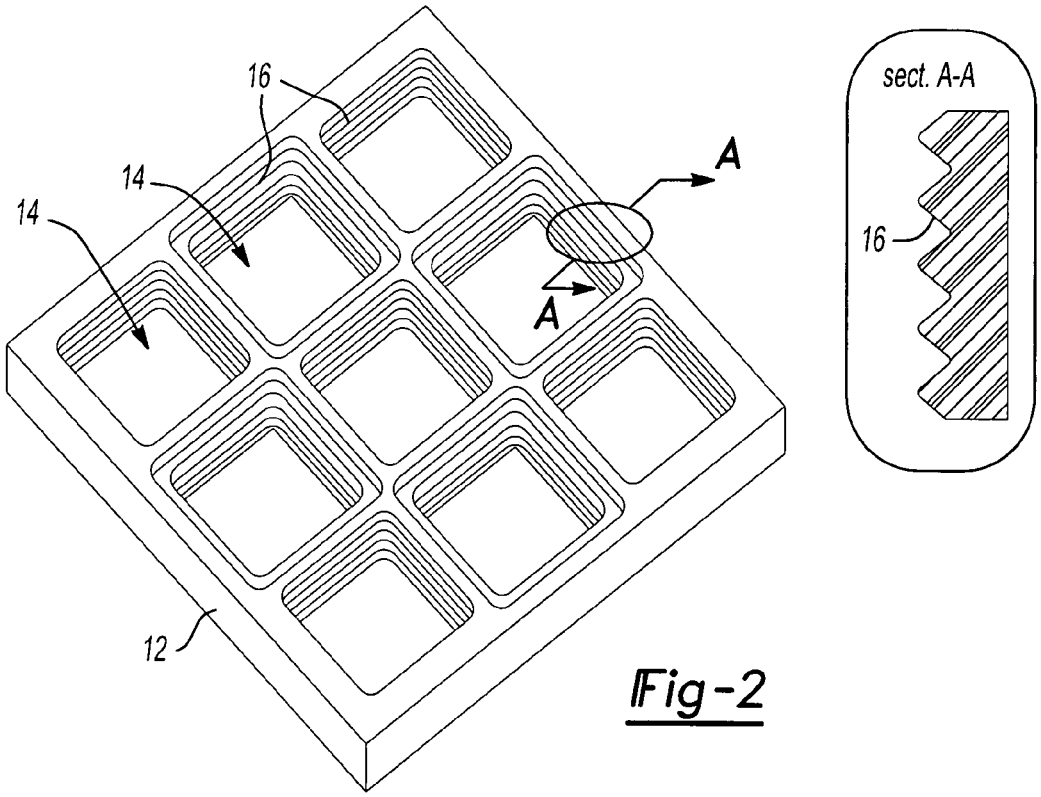
FIG. 2 is a perspective view of an exemplary window-frame structure for the soft x-ray radiation device.
Figure 3:
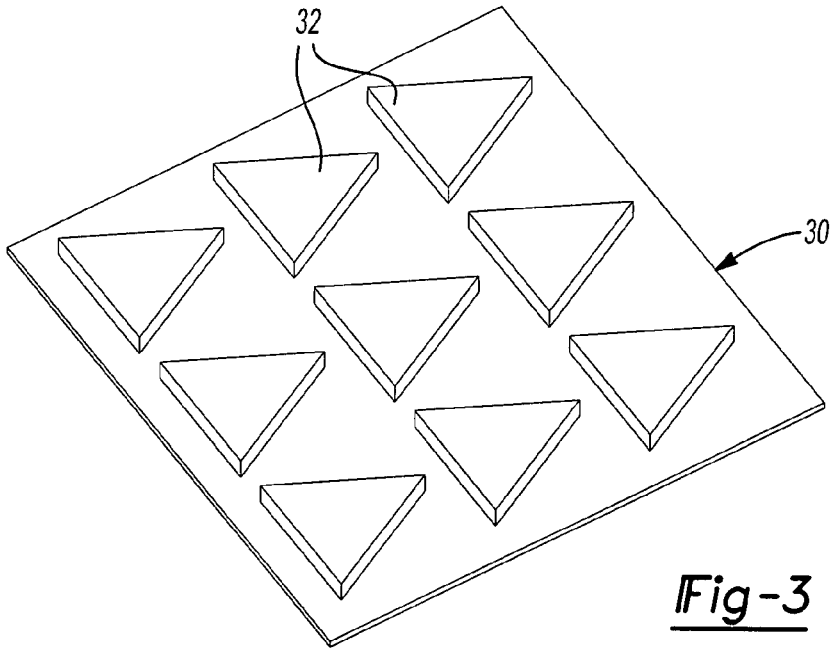
FIG. 3 is a perspective view of an exemplary cathode assembly.

FIGS. 1-6 illustrate an integrated soft x-ray radiation device 10 according to the principles of the present disclosure. The x-ray radiation device 10 is built around an electrically insulating window-frame structure 12 having a plurality of channels 14 passing therethrough as shown in FIG. 2. In an exemplary embodiment, the window-frame structure is a hexahedron such that the channels extend between opposing faces of the hexahedron. More specifically, the window-frame structure 12 may be a square cuboid, such that channels extend between the square faces of the cuboid. It is envisioned that the window-frame structure may have other geometrical shapes, such as but not limited to, hexagonal honeycomb structures or bundled cylinders.

Each channel 14 will form a pixel for the x-ray radiation device. Collectively, the plurality of channels 14 are preferably arranged in an array to form a pixel arrangement. In the exemplary embodiment, nine channels form a pixel 3×3 array. Each channel is in the form of a hexahedron (e.g., a cube) as shown. However, other shapes are also contemplated. In addition, one or more ribs 16 as shown in section A-A of FIG. 2 may be formed in each channel. Each rib 16 is formed along the interior surface of the window-frame structure and protrudes inwardly into the channel. These ribs 16 are intended to increase the breakdown voltage of the window-frame structure 12.

To meet the breakdown voltage requirements of an x-ray application, the window-frame structure 12 is preferably comprised of a ceramic material. In an exemplary implementation, the window-frame structure is formed with a low temperature co-fired ceramic process as described in U.S. Pat. No. 5,176,771 which is incorporated by reference herein. This process employs dielectric sheets in the form of low-temperature cofired ceramic tape. The tape contains a material such as a mixture of glass and ceramic fillers which sinter at about 850 C and exhibit thermal expansion similar to Alumina. The tape sheets are metallized to make a ground plane, signal plane, bonding plane or the like, or they may be formed with vias, which are filled with metallizations to form interconnect layers. The sheets of tape are stacked on each other, laminated together at a relatively low laminating temperature and pressure, and then fired to sinter the ceramic material in the tape. Other types of ceramic processes are contemplated by this disclosure.

An individual radiation source is formed by each channel in the window-frame structure. A cathode is disposed on one side of each channel and is operable to emit electrons into the channel. Emitted electrons are accelerated towards an anode disposed on an opposing side of the channel. When electrons impinge upon the surface of the anode, x-ray radiation is emitted therefrom. Each radiation source is configured to emit radiation at a diffused angle such that radiation from a given pixel overlaps with radiation from adjacent pixels.

Figure 7:
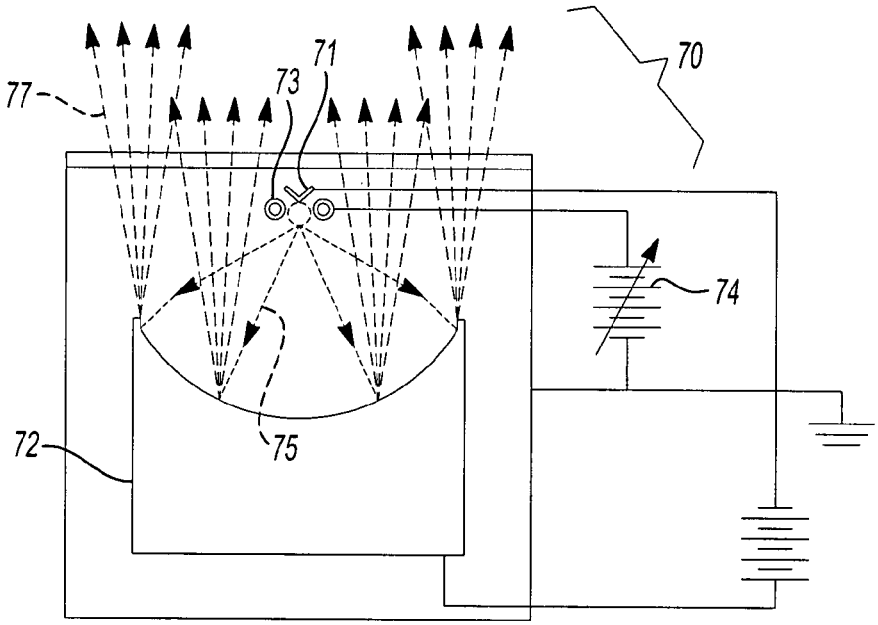
FIG. 7 is a diagram of an x-ray source that has been modified to diffuse the radiation.

A conventional x-ray source may be modified to achieve a diffused source 70 in the manner shown in FIG. 7. Three major modifications have been made to the conventional design to accomplish electron spreading. First, the cathode 71 is electrically tied to ground to avoid any self-bias voltage; the load resistor has been removed. Second, the surface figure of the anode 72 has been curved into a concave shape. Third, a supplementary electrode 73 called the field sculpting electrode is placed surrounding the electron current in the close vicinity to the cathode and is biased by a variable voltage 74. These changes cause the electric field lines 75 to spread out, drawing the electron current to impact uniformly across the anode surface. In turn, this results in an illumination of the absorber which is diffuse, as indicated by the x-ray trajectories 77. The term "diffused radiation angle" refers to the source possessing the characteristic of a large radiating surface area as viewed by the absorbing material in the contaminated environment, resulting in lowered shadow contrast to avoid having local unirradiated regions.

In an exemplary embodiment, a plurality of cathodes 32 are formed on a plate 30 (collectively referred to as the cathode assembly), such that one cathode will align with and protrude into each channel of the window-frame structure when positioned adjacent thereto. The cathode plate 30 is formed of an x-ray transparent material such that radiation may be emitted from each pixel.

Figure 4A:
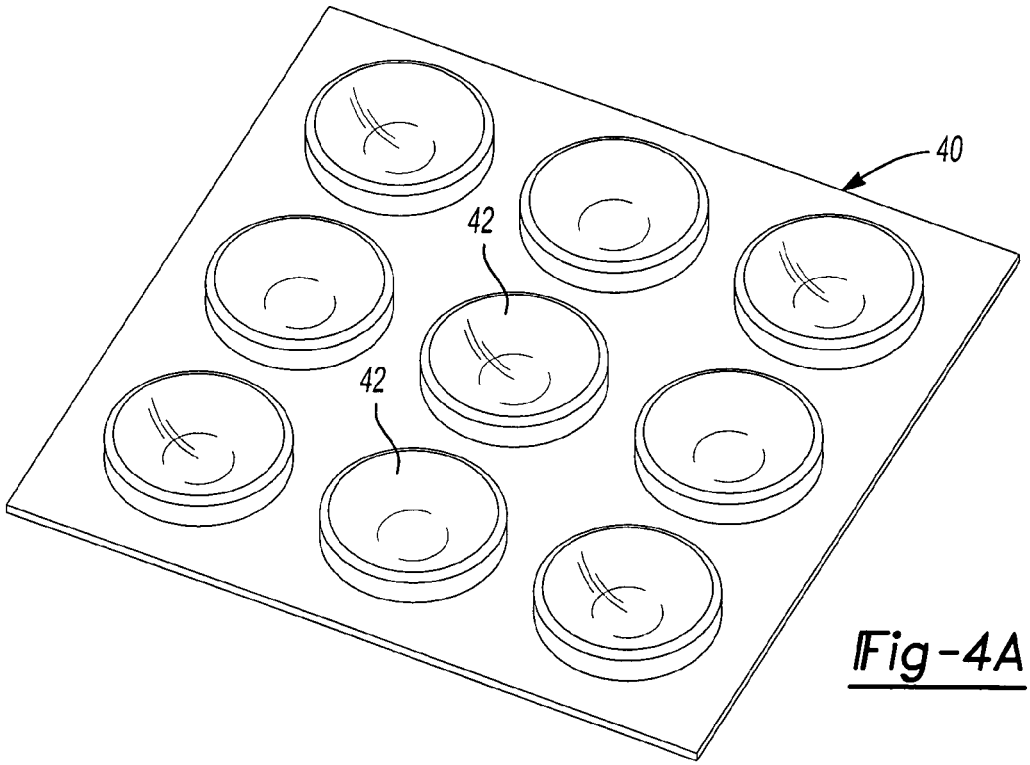
FIGS. 4A and 4B are perspective views of exemplary anode plates.
Figure 4B:
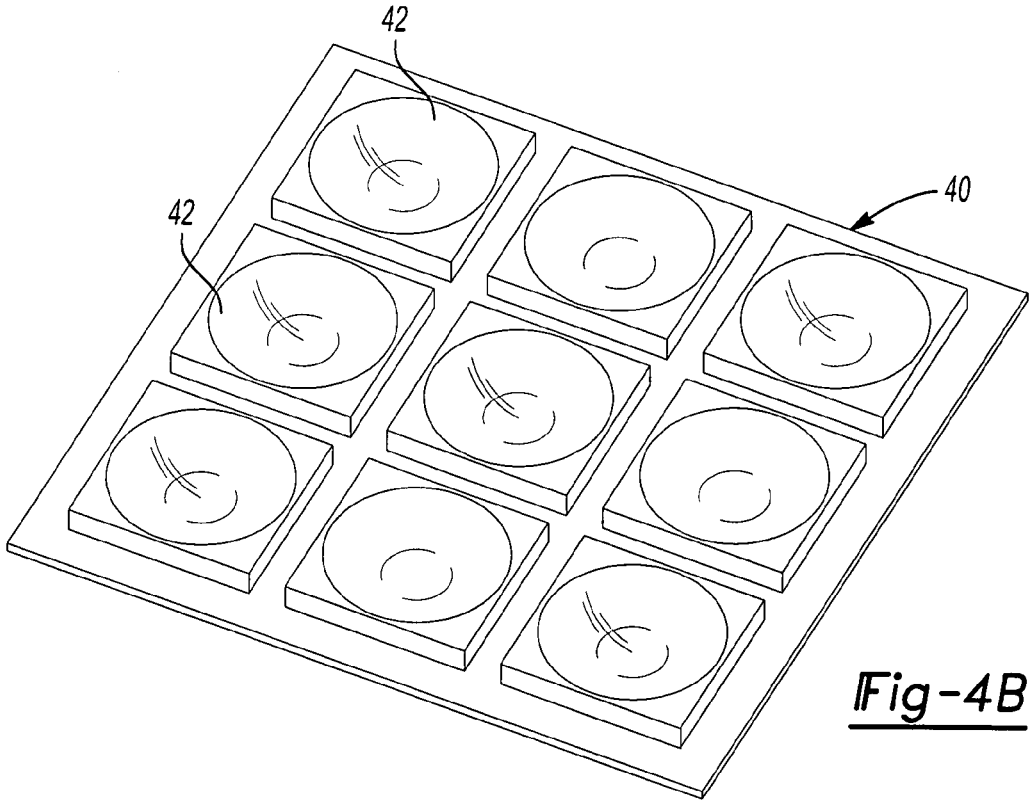
Figure 4C:
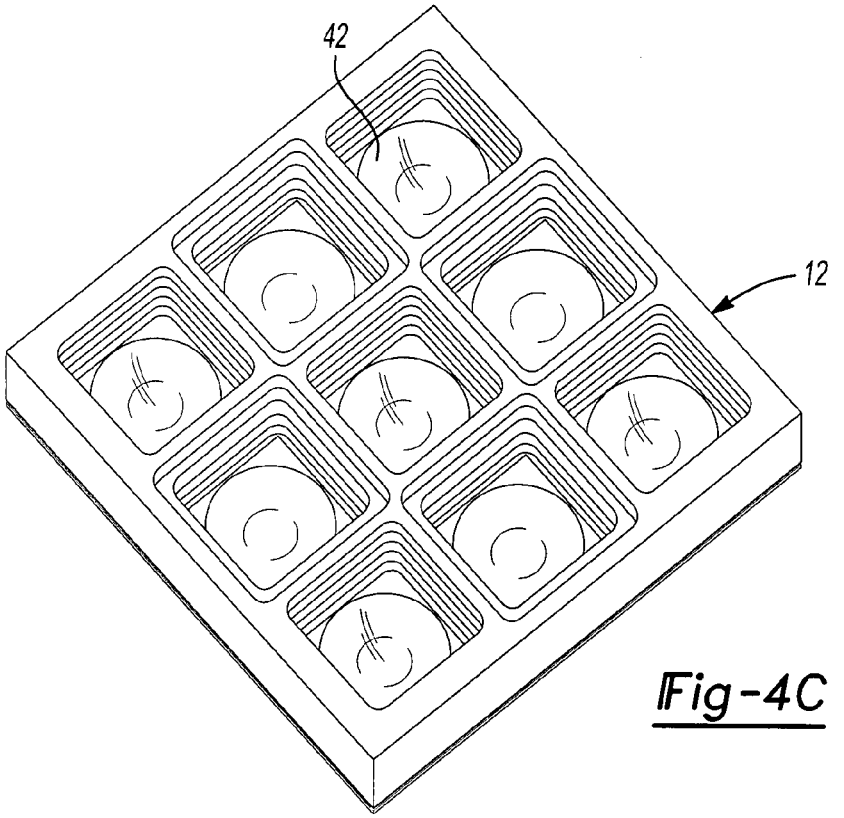
FIG. 4C is a perspective view of an exemplary anode plate mated with the window-frame structure.

In a complementary manner, a plurality of anode surfaces 42 are formed on another plate 40. Anodes may have different shapes, including a round shape or a square shape as shown in FIGS. 4A and 4B, respectively. In either case, each anode preferably provides a concave surface for diffusing emitted electrons. The anode plate is positioned on an opposing side of the channels from the cathode plate.

The photon energies produced by an x-ray source can be scaled through the judicious choice of cathode and anode materials. This is understood through Moseley's empirical formula for k-alpha x-rays. For instance, an x-ray source having a molybdenum (Z=42) anode will generate radiation having a photon energy of 18 keV; whereas, a silver (Z=47) anode can generate radiation having a photon energy of 22 keV. It is envisioned that x-ray sources will be fabricated with different cathode and anode materials depending on the application for the radiation device.

An integrated x-ray radiation device 10 further includes controlling electronics 54 for each radiation source. In the exemplary embodiment, the electronic components 54 are mounted onto a bottom surface of an insulating member 50. The top surface of the insulating member 50 is positioned adjacent to the anode plate 40. The insulating member 50 is preferably made of a ceramic material or other types of insulating materials. In this way, the insulating member 50 thermally isolates the electronic components from the active radiation sources.

Figure 5:
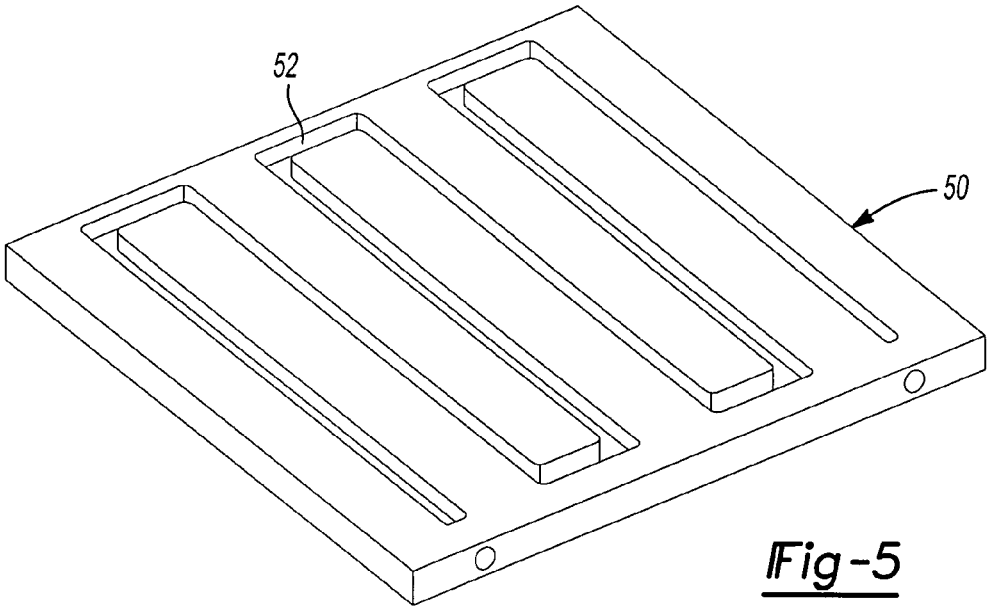
FIG. 5 is a perspective view of an exemplary insulating member.

With reference to FIG. 5, the insulating member 50 may support a cooling mechanism for the device. In particular, one or more fluidic cooling channels 52 are formed into the top surface of the insulating member 50. The channels 52 are used for conducting a liquid or gas coolant. In an exemplary embodiment, the cooling channels 52 are formed using a low temperature co-fired ceramic process. A preferred technique for forming the channels is described in U.S. Patent Application Publication No. 2003/0192636 which is incorporated by reference herein. Other techniques are also contemplated by this disclosure.

Figure 6:
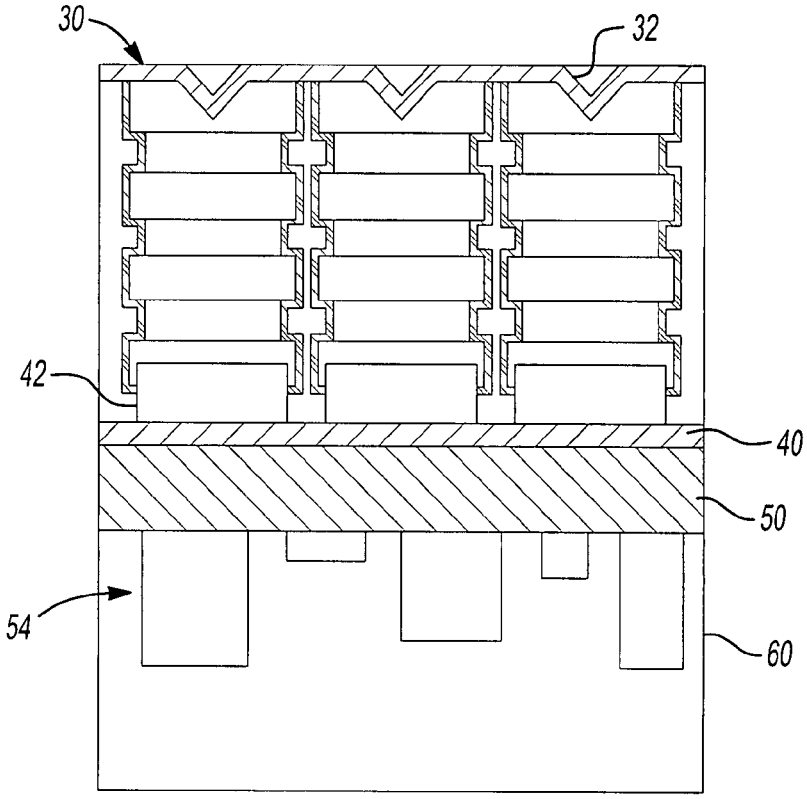
FIG. 6 is a cross-sectional side view of the integrated soft x-ray radiation device.

A housing 60 provides an enclosure for the x-ray radiation device as best seen in FIG. 6. The housing 60 cooperatively functions with the cathode assembly 30 to enclose the components of the x-ray radiation device. The housing seals and maintains the x-ray producing components of the device under permanent high vacuum. It is to be understood that only the primary components of the x-ray radiation device are discussed above, but that other components may be needed to control and manage the overall operation of the device.

Figure 8:
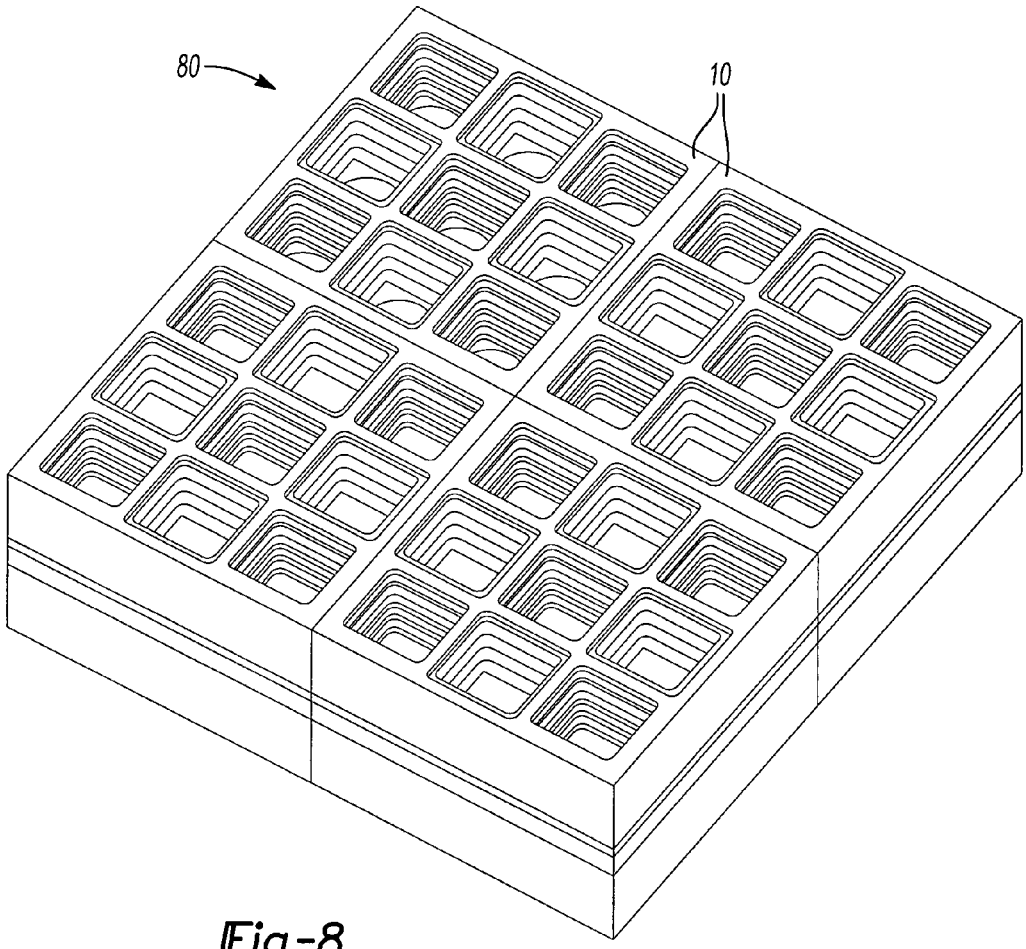
FIG. 8 is a diagram illustrating how multiple soft x-ray devices may be tiled together.

With reference to FIG. 8, it can be appreciated that multiple x-ray radiation devices 10 may be tiled together to form a larger radiation assembly 80. The tiling approach enables the ability to add or remove tiles as an application might warrant. The tiling approach easily accommodates varying aspect ratios, housing approaches or to increase irradiation time in the case of an in-line belt driven decontaminator.

Figure 9:
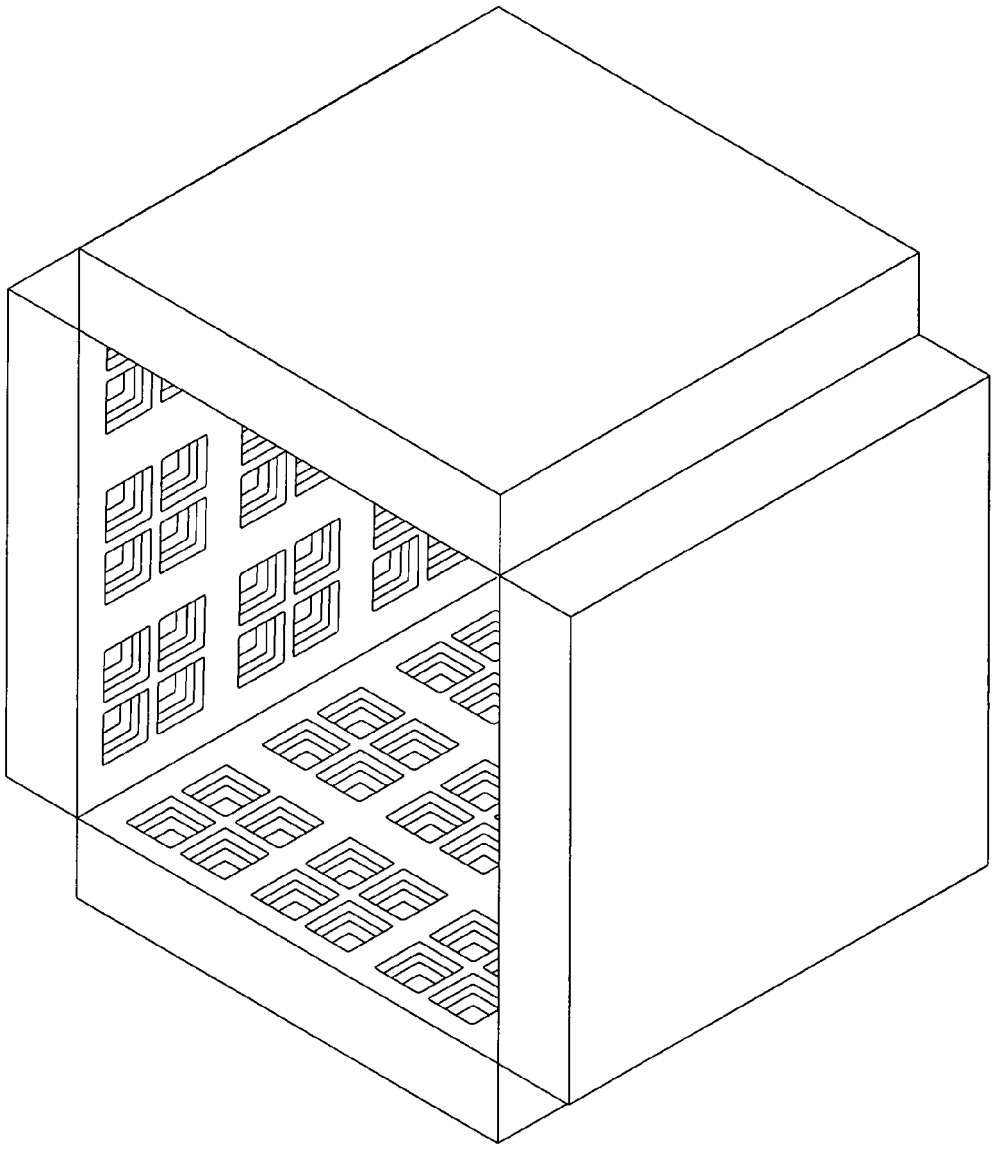
FIG. 9 is a diagram of one possible three-dimensional construction of the soft-x-ray devices.

With reference to FIG. 9, such a tiling as described above may be carried to three-dimensional constructions, allowing the irradiation of specific volumes from many directions simultaneously. Devices thus formed may have completely enclosed irradiation volumes, or they may be open-ended to allow long objects to be passed through.

The above description is merely exemplary in nature and is not intended to limit the present disclosure, application, or uses.

What is claimed is:

1. An integrated x-ray radiation device, comprising:

a window-frame structure comprised of ceramic material and having a plurality of channels passing between opposing surfaces of the window-frame structure, a plurality of ribs extend inwardly into each channel and are integrally formed from the ceramic material that defines each channel, where each channel contains an x-ray source;

a cathode assembly disposed adjacent to one of the surfaces of the window-frame structure having the plurality of channels formed therein;

an anode plate disposed adjacent to a surface of the window-frame structure opposite from the cathode plate;

an insulating member having a top surface adjacent to the anode plate and a bottom surface for mounting electronic components thereto;

one or more cooling channels formed in the top surface of the insulating member to provide a cooling mechanism; and a housing that cooperatively functions with the anode plate to form an enclosure for the electronic components of the x-ray radiation device.

2. The x-ray radiation device of claim 1 wherein the cathode assembly provides a cathode for each channel and the anode plate provides an anode for each channel, such that electrons emitted from a given cathode impinge on a corresponding anode within a given channel.

3. The x-ray radiation device of claim 2 wherein each anode provides a concave surface for electrons from a cathode to impinge upon.

4. The x-ray radiation device of claim 1 wherein the window-frame structure is a hexahedron and the plurality of channels are formed substantially as cubes and arranged in an array.

5. The x-ray radiation device of claim 1 further comprises electronic components mounted onto a bottom surface of the insulating member for driving each x-ray source.

6. The pixel array arrangement of claim 1 wherein the window-frame structure is formed using a low temperature co-fired ceramic process.

7. An x-ray radiation apparatus comprised of two-dimensional or three-dimensional tiling x-ray radiation devices, where each x-ray-radiation device is constructed in accordance with claim 1.

* * * * *